US009395062B2

(12) United States Patent
Chen

(10) Patent No.: US 9,395,062 B2
(45) Date of Patent: Jul. 19, 2016

(54) LANTERN

(71) Applicant: Xiang Chen, Taizhou (CN)

(72) Inventor: Xiang Chen, Taizhou (CN)

(73) Assignee: Zhejiang DingXing Arts & Crafts Co., Ltd, Taizhou (CN)

( * ) Notice: Subject to any disclaimer, the term of this patent is extended or adjusted under 35 U.S.C. 154(b) by 44 days.

(21) Appl. No.: 14/582,188

(22) Filed: Dec. 24, 2014

(65) Prior Publication Data

US 2015/0184825 A1 Jul. 2, 2015

(30) Foreign Application Priority Data

Dec. 31, 2013 (CN) ..... 2013 2 0894969
Dec. 31, 2013 (CN) ..... 2013 2 0894976
Dec. 31, 2013 (CN) ..... 2013 2 0894980

(51) Int. Cl.

| | |
|---|---|
| ***F21V 3/02*** | (2006.01) |
| ***F21V 21/08*** | (2006.01) |
| ***F21V 35/00*** | (2006.01) |
| *F21S 6/00* | (2006.01) |
| *F21W 121/00* | (2006.01) |

(52) U.S. Cl.

CPC ..... *F21V 3/023* (2013.01); *F21V 21/08* (2013.01); *F21V 35/00* (2013.01); *F21S 6/001* (2013.01); *F21W 2121/00* (2013.01)

(58) Field of Classification Search

CPC ..... A01M 1/04; F21V 1/00; F21V 11/00; F21V 11/06; F21V 3/00; F21V 19/00; F21S 6/00; F21S 13/12; F21S 6/001; F21Y 101/02; F21W 12/00; F21W 2121/00; F21W 2121/002

See application file for complete search history.

(56) References Cited

U.S. PATENT DOCUMENTS

| | | | | |
|---|---|---|---|---|
| 1,641,549 | A * | 9/1927 | Paulus | F42B 10/56 102/346 |
| 6,688,035 | B1 * | 2/2004 | Shichman | A01M 1/023 43/107 |
| 8,319,649 | B1 * | 11/2012 | Devane | A01M 1/026 340/552 |
| 2003/0061757 | A1 * | 4/2003 | Askin | A01M 1/023 43/112 |
| 2003/0217503 | A1 * | 11/2003 | Robison | A01M 1/023 43/114 |
| 2009/0073696 | A1 * | 3/2009 | Melzner | F21V 9/10 362/279 |

FOREIGN PATENT DOCUMENTS

| | | |
|---|---|---|
| CN | 00227753.0 | 4/2000 |
| CN | 200720084586 | 4/2007 |
| JP | 2004247287 A * | 9/2004 |

* cited by examiner

*Primary Examiner* — Hargobind S Sawhney
(74) *Attorney, Agent, or Firm* — Minder Law Group; Willy H. Wong

(57) ABSTRACT

The present invention provides a lantern in the technical field of illumination device, The lantern comprises an outer lantern body, a top ring, a bottom ring and a hanger, The hanger includes two parallel elastic side bars. The inner ends of the said two side bars sequentially pass through the top ring and the cylindrical body and are fixed onto the bottom ring. Several grabs are fixed on the two side bars along their lengthwise directions respectively. The grab includes a fixing plate, a side plate and a clamp plate. The fixing plate is fixed on the side bar. The inner end of the side plate is connected with the fixing plate with an obtuse angle formed therebetween. The outer end of the side plate is connected with the clamp plate. The clamp plate is spaced from the side bar with an opening formed therebetween to face the bottom ring.

15 Claims, 7 Drawing Sheets

LANTERN

RELATED APPLICATIONS

This application claims benefit of Chinese Patent Application No. CN201320894969.9, filed Dec. 31, 2013, Chinese Patent Application No. CN201320894976.9, filed Dec. 31, 2013, and Chinese Patent Application No. CN201320894980.5, filed Dec. 31, 2013. The above applications are incorporated by reference herein.

BACKGROUND OF THE INVENTION

1. Field of Invention

The present invention relates to a lantern in the technical filed of illumination device.

2. Related Art

The lantern is closely related with life of the Chinese. There are lanterns everywhere, for example in temples and guest rooms. In the past, lanterns were used as an illumination device, and nowadays, lanterns are more of a decorative function. The lanterns used to be made of materials including paper and bamboo, and are usually made of cloth, plastic and iron wires. The shape and color of the lanterns today are different from those in old days.

A Chinese patent which has a publication number CN201673376U and was published on Dec. 15, 2010, discloses a telescopic steel wire lantern, comprising an outer lantern body, a chassis, a top frame and a couple, in which the outer lantern body is a cylindrical body configured by interlocking a plurality of steel wires, and each end of the cylindrical body is connected with a fixed ring respectively; an upper edge of the chassis and a lower edge of the top frame are provided with several grooves, the chassis is hung onto the fixed ring below the outer lantern body via the grooves, the top frame is hung onto the fixed ring on the outer lantern body via the grooves, and the chassis and the top frame will not be released from the outer lantern body after the openings of the grooves are closed; the coupe is of a U-shape, a grab is provided on each outer side of the waist part of the couple, and two slots are symmetrically disposed on the inner sides of the top frame. In use, the top frame is pressed down, and the grabs will fall into the slots and be locked. As such, the outer lantern body will form a desired lantern shape. The volume of the lantern will be reduced by several times after contraction, which reduces the storage space and saves the transportation cost.

The lantern in the said patent could only be adjusted in a single level and only few shapes of lantern could be achieved, which could not meet the demands of different users and has a poor adaptability. Moreover, the steel wires of the lantern could not be conveniently mounted and the connection is not reliable.

SUMMARY OF THE INVENTION

An object of the invention is to provide a lantern to address the problems existing in the prior art. The technical problems to be addressed the present invention include to improve the multi-level adjustment functions of the lantern, the convenience and reliability of the mounting of the lantern.

The present invention provides a lantern, comprising an outer lantern body, a top ring, a base and a hanger, in which the outer lantern body includes a cylindrical body configured by interweaving a plurality of elastic steel wires and the top ring and the base are respectively connected with the upper and lower ends of the cylindrical body. The hanger includes two parallel elastic side bars. The inner ends of the said two side bars sequentially pass through the top ring and the cylindrical body and are fixed onto the base. Several grabs are fixed on the two side bars along their lengthwise directions respectively. The grab includes a fixing plate, a side plate and a clamp plate. The fixing plate is fixed on the side bar. The inner end of the side plate is connected with the fixing plate with an obtuse angle formed therebetween. The outer end of the side plate is connected with the clamp plate. The clamp plate is spaced from the side bar with an opening formed therebetween to face the base. The top ring could be engaged with the opening.

According to the operation principle of the lantern, several grabs are provide on both side bards of the lantern, which could achieve multi-level adjustment to adjust different states of the lantern in accordance with different demands of the customer. Moreover, when the top ring slides from up to down, the side plate could take a guide function as the side plate is provided on the grab. That is to say, when the inner circumference of the top ring moves along the slide plate, the side plate could flexibly swing the elastic side bars inward, which reduces the distance between the two side bars, so that the top ring slides beneath the grab. Thereafter, the top ring slightly slides up, and the top ring is engaged with the opening. In this solution, when downward adjustment is made, no man power is needed to press the side bars to swing inward. As such, the operation is fast and convenient and the labor intensity is low. The materials of the side bars are the same as each material in the prior art, and the description thereof is omitted herein for brevity.

In the lantern as mentioned above, the outer ends of the two side bars are fixedly connected with each other via a cross bar, and the central part of the cross bar bends outward to form a couple. The couple is provided in such a way that the lantern could be conveniently hung onto a rope or other pendants to make the lantern unlikely to shake.

In the lantern as mentioned above, a transparent housing is provided on the base, and an electronic candle is inserted within the transparent housing. The electronic candle is provided in such a way that the aesthetic nature of the lantern could be improved while the illumination thereof is guaranteed.

In the lantern as mentioned above, the thickness of the top ring is smaller than the opening degree of the opening. The thickness of the top ring is smaller than the opening degree of the opening, so that the top ring could smoothly slide into the opening. At that time, the two side bars are under stress to restore outward, and are pressed against the top ring by means of the stress, which further improves the reliability in connection of the top ring with the side bars.

In the lantern as mentioned above, the obtuse angle formed between the side plate and the fixing plate is 135 degree. The obtuse angle between the side plate and the fixing plate is configured to be 135 degree, so that the top ring could smoothly slide downward. On the other hand, if the obtuse angle is close to 90 degree, the difficulty for the top ring to slide downward is obvious; and if the obtuse angle is close to 180 degree, the guide function is poor.

In the lantern as mentioned above, in one embodiment, connecting holes are provided at the edge of the top ring and base to pass the steel wires. The connecting holes facilitate passage of the steel wires and are connected with the steel wires.

In the lantern as mentioned above, in another embodiment, both the top ring and the base are of an annular shape and provided with several circumferentially distributed curl hems. An annular fixing loop is provided within the curl hem, and the steel wire is fastened to the fixing loop. The curl hem is used to fix the fixing loop and both ends of the steel wire are fastened to the fixing loops of the top ring and base respectively.

In the lantern as mentioned above, the fixing loop includes an upper fixing loop fixed on the top ring along the edge thereof and a lower fixing loop fixed on the base along the edge thereof. The edge of the top ring is provided with upper fixing ports evenly distributed in the circumferential direction, the edge of the base is provided with lower fixing ports evenly distributed in the circumferential direction. The steel wires include several first steel wires and several second steel wires that are intersected with each other. Both ends of the first steel wire are connected with the upper fixing loop and the lower fixing loop respectively. Both ends of the second steel wire are connected with the upper fixing loop and the lower fixing loop respectively. Each section of the upper fixing loop within the upper fixing port is connected with a first steel wire and a second steel wire, and each section of the lower fixing loop within the lower fixing port is connected with a first steel wire and a second steel wire. The first steel wires and the second steel wires are interwoven with each other to form an interlaced configuration. The first steel wires and the second steel wires are configured so that two layers of housing of steel wires are formed in the lantern. These two layers of housing of steel wires interact with each other to largely increase the overall strength of the lantern. The overall strength of the steel wires is increased thereby. The positions of both ends of the first steel wires and second steel wires are reasonably distributed, so that the housing of the lantern formed by the steel wires is under uniform stress, which further improves the overall strength of the lantern.

In the lantern as mentioned above, the curl hem includes a first curl hem between the lower fixing ports on the edge of the base and a second curl hem between the upper fixing ports on the edge of the top ring. A first fixed channel is formed between the first curl hem and the base. The lower fixing loop passes through the first fixed channel and is fixed on the base. A second fixed channel is formed between the second curl hem and the top ring. The upper fixing loop passes through the second fixed channel and is fixed on the base.

In the lantern as mentioned above, each of the ends of the first steel wire is provided with a first hook part. A first mounting hole is formed between the first hook part and the first steel wire to pass the upper fixing loop or the lower fixing loop. Each of the ends of the second steel wire is provided with a second hook part. A second mounting hole is formed between the second hook part and the second steel wire to pass the upper fixing loop or the lower fixing loop. The first hook part is not pressed against the first steel wire during mounting. After the first steel wire is located at the upper fixing loop or the lower fixing loop, the first hook part is pressed against the first steel wire. The second hook part is not pressed against the second steel wire during mounting. After the second steel wire is located at the upper fixing loop or the lower fixing loop, the second hook part is pressed against the second steel wire. A simple structure and convenient mounting are provided to facilitate replacement of the first and second steel wires, which further facilitates maintenance of the lantern.

In the lantern as mentioned above, the each section of the upper fixing loop within the upper fixing port and the each section of the lower fixing loop within the lower fixing port are both provided with a positioning cover. Each of the ends of the positioning cover is provided with a gap to pass the first steel wire and the second steel wire. The first hook part and the second hook part are respectively located within the gaps. The positioning covers are covered on the upper fixing loop and the lower fixing loop. The first hook part and second hook part are closely pressed against the upper and lower fixing loops through the positioning covers, which provides a compact structure of the lantern and in improved strength of the lantern.

In the lantern as mentioned above, the first steel wires are disposed along the clockwise direction and the second steel wires are disposed along the anti-clockwise direction. The second steel wires inclined in the anti-clockwise direction and the first steel wires inclined in the clockwise direction intersect with each other. Both the first and second steel wires project outward to provide a spherical housing.

In the lantern as mentioned above, the steel wires could be configured in another manner, in which the first steel wires are vertically disposed and the second steel wires are obliquely disposed.

In the lantern as mentioned above, a first loop fastener is formed by knotting in the middle of each of the said first steel wires. A second loop fastener is formed by knotting in the middle of each of the said second steel wires. The first loop fastener of the first steel wire is fastened with the second loop fastener of the second steel wire at the intersection. The first loop fasteners and the second loop fasteners are formed by bending the first steel wires and the second steel wires respectively. When the first loop fastener is to be connected with the second loop fastener, the first loop fastener could be firstly formed by knotting and then the second steel wire passes through the first loop fastener to form a second loop fastener by knotting. This way, the first and second loop fasteners are coupled with each other. No additional fixing element is required to fasten the first steel wires to the second steel wires, which provides a simple and deft structure and convenient and fast forming. The first loop fastener is connected with the second fastener in such a manner that the strength of connection of the first steel wire with the second steel wire is improved, which further enhances the strength of the lantern. Furthermore, the first and second loop fasteners are located in the middle, for which the outer lantern body does not tend to deform.

In the lantern as mentioned above, the steel wires are coated with anti-corrosive lacquer. The anti-corrosive lacquer prevents the steel wires corroding, prolongs the use life and provides an aesthetic appearance.

The present invention provides the following advantages over the prior art.

First, several grabs are provided on each of two side bars of the lantern of the invention, which could achieve multi-level adjustment by adjusting different states of the lantern in accordance with different demands of the customer.

Second, when the top ring slides from up to down, the side plate could take a guide function as the side plate is provided on the grab. That is to say, when the inner circumference of the top ring moves along the slide plate, the side plate could flexibly swing the elastic side bars inward, which reduces the distance between the two side bars, so that the top ring slides beneath the grab. Thereafter, the top ring slightly slides up, and the top ring is engaged with the opening. In this solution, when downward adjustment is made, no man power is needed to press the side bars to swing inward. As such, the operation is fast and convenient and the labor intensity is low.

Third, the obtuse angle between the side plate and the fixing plate is configured to be 135 degree, so that the top ring could smoothly slide downward. On the other hand, if the obtuse angle is close to 90 degree, the difficulty for the top ring to slide downward is obvious; and if the obtuse angle is close to 180 degree, the guide function is poor.

Fourth, the first steel wires are connected with the second steel wires in a firm and reliable manner through the first loop fasteners and the second loop fasteners, which provides the lantern with a compact structure and high overall strength.

Fifth, the housing of the lantern has an aesthetic and decent appearance. The first steel wires are connected with the second steel wires by using the loop fasteners formed by knotting when intersecting, which provides convenient forming and a simple and reliable structure.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

Figure 1:
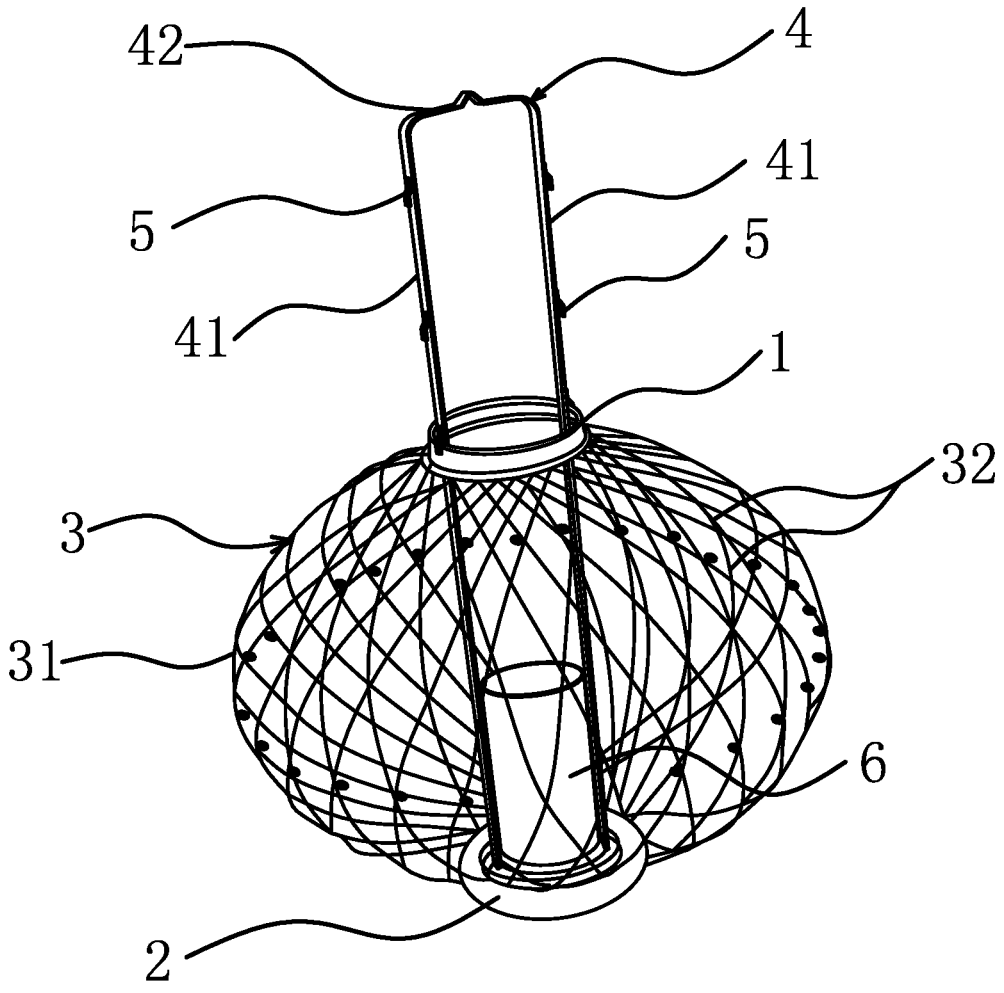
FIG. 1 is a stereoscopic structural diagram of one embodiment of the lantern of the invention.

The embodiments of the invention will be described below and the technical solutions of the invention will be further illustrated in connection with the accompanying figures. However, the present invention shall not be limited to these embodiments.

First Embodiment

As shown in FIGS. 1-5, the lantern of the invention comprises an outer lantern body 3, a top ring 1, a base 2, and a hanger 4. The outer lantern body 3 includes a cylindrical body 31 configured by interweaving a plurality of elastic steel wires 32. The top ring 1 and the base 2 are respectively connected with the upper and lower ends of the cylindrical body 31. The hanger 4 includes two parallel elastic side bars 41, and the inner ends of the said two side bars 41 sequentially pass through the top ring 1 and the cylindrical body 31 and are fixed onto the base 2. The outer ends of the two side bars 41 are fixedly connected with each other through a cross bar 42, and the central part of the cross bar 42 bends outward to form a couple 43. A transparent housing 6 is provided on the base 2, and an electronic candle is inserted within the transparent housing 6.

Figure 2:
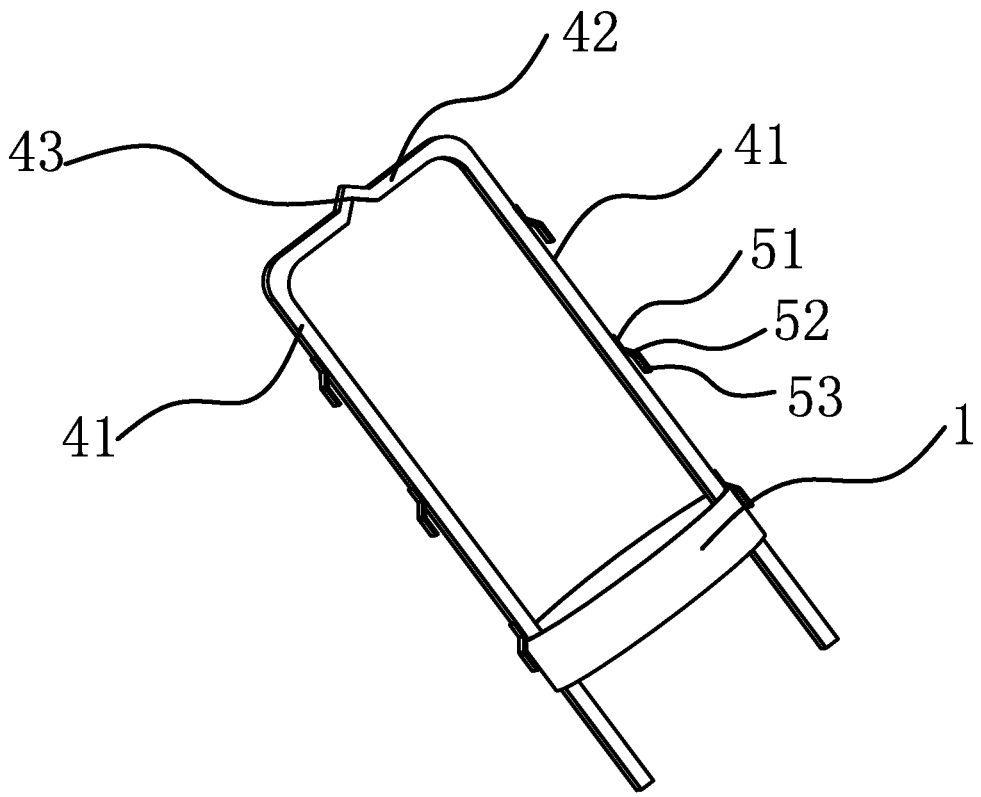
FIG. 2 is a diagram of one embodiment of the connection of the top ring with the side bars in the lantern of the invention.
Figure 3:
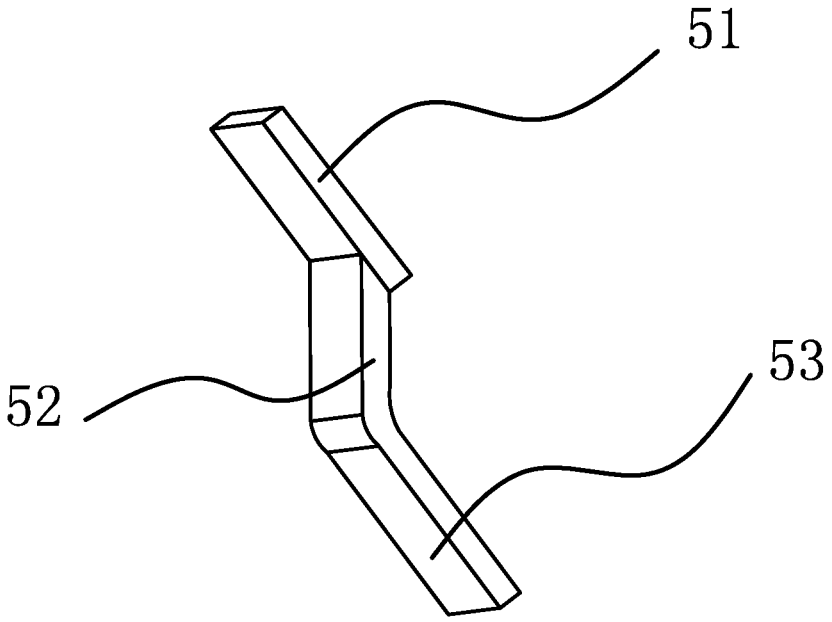
FIG. 3 is a structural diagram of one embodiment of the grab in the lantern of the invention.

As shown in FIGS. 2 and 3, three grabs 5 are fixed to two side bars 41 along their lengthwise direction respectively. The grab 5 includes a fixing plate 51, a side plate 52 and a clamp plate 53. The fixing plate 51 is fixed on the side bar 41, the inner end of the side plate 52 is connected with the fixing plate 51 with an obtuse angle formed therebetween, and an obtuse angle of 135 degree is formed between the side plate 52 and the fixing plat 51. The outer end of the side plate 52 is connected with the clamp plate 53 and the clamp plate 53 is spaced from the side bar 41 with an opening formed therebetween to face the base 2. The top ring 1 could be engaged with the opening. The thickness of the top ring 1 is smaller than the opening degree of the opening.

Each of the two side bars 41 of the lantern is provided with three grabs 5, which could achieve level-by-level adjustment. Consequently, different states of the lantern could be adjusted in accordance with different demands of the customer. Moreover, when the top ring 1 slides from up to down, the side plate 52 could take a guide function as the side plate 52 is provided on the grab 5. That is to say, when the inner circumference of the top ring 1 moves along the slide plate 52, the side plate 52 could flexibly swing the elastic side bars 41 inward, which reduces the distance between the two side bars 41, so that the top ring 1 slides beneath the grab 5. Thereafter, the top ring 1 slightly slides up, and the top ring 1 is engaged with the opening. In this embodiment, when downward adjustment is made, no man power is needed to press the side bars 41 to swing inward. As such, the operation is fast and convenient and the labor intensity is low.

Figure 4:
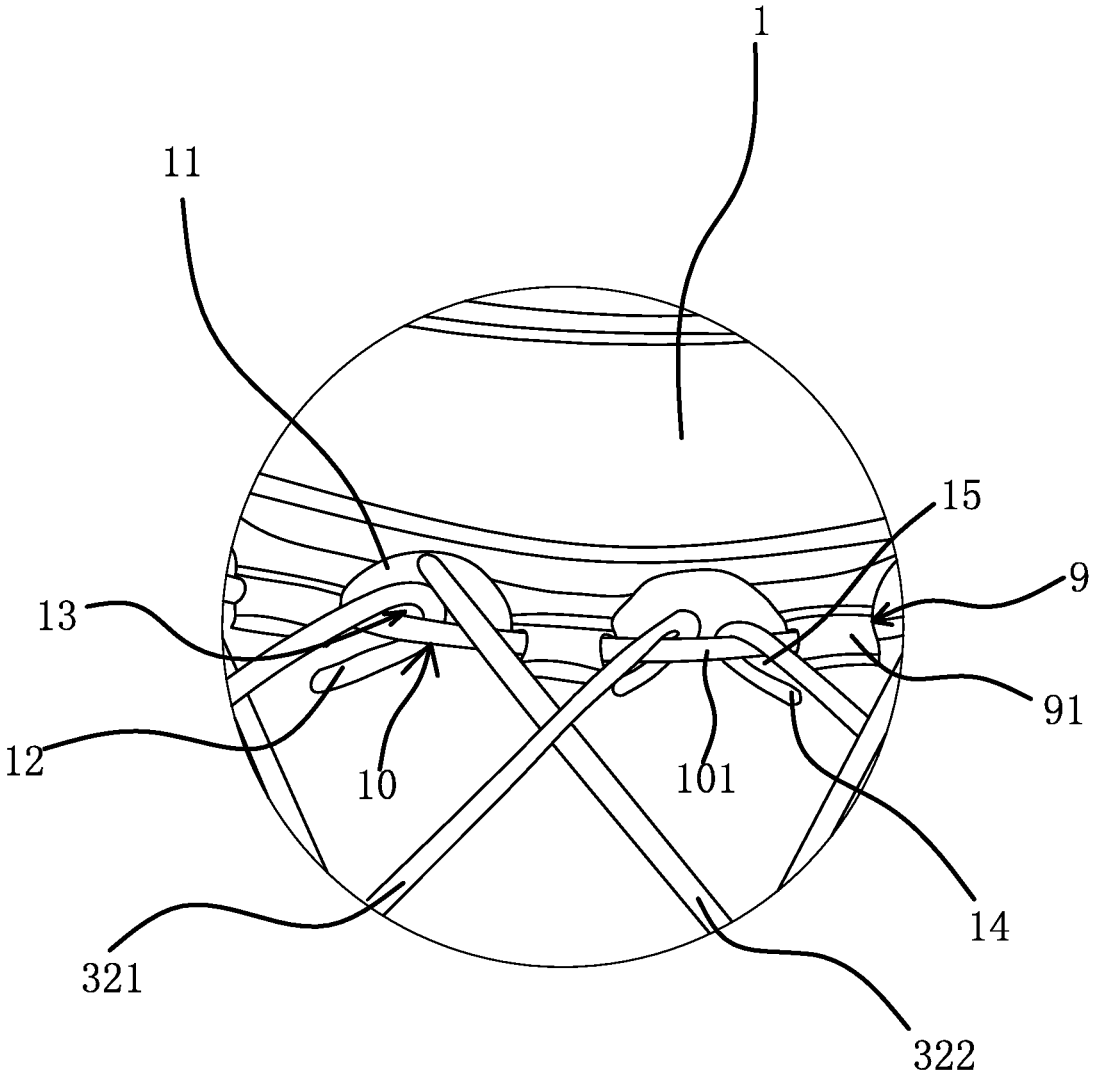
FIG. 4 is a diagram of one embodiment of the connection of the first steel wire and the second steel wire with the top in the lantern according to the first embodiment.
Figure 5:
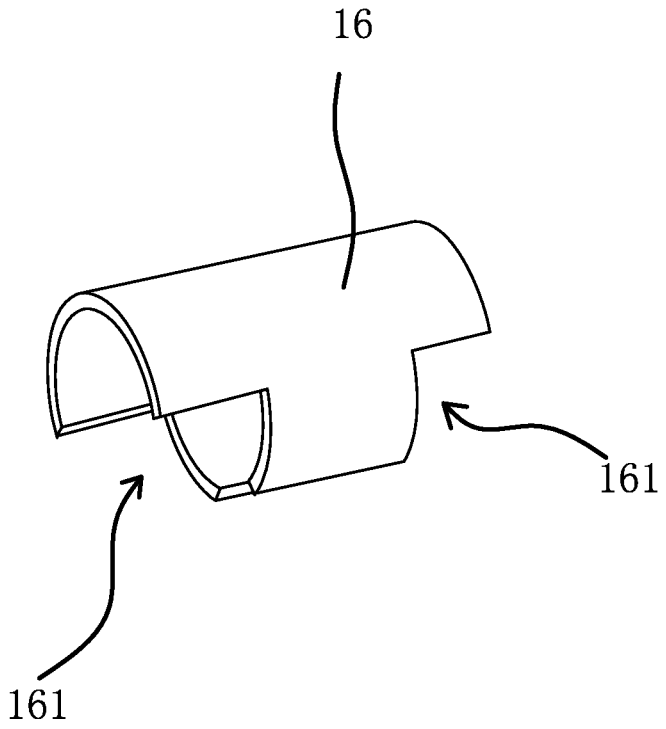
FIG. 5 is a stereoscopic structural diagram of one embodiment of the positioning cover in the lantern of the invention.

Referring to FIGS. 1, 4 and 5, the fixing loop 10 includes an upper fixing loop 101 fixed on the edge of the top ring 1 and a lower fixing loop 102 fixed on the edge of the base 2. The edge of the top ring 1 is provided with upper fixing ports 11 evenly distributed in the circumferential direction. The edge of the base 2 is provided with lower fixing ports 11 evenly distributed in the circumferential direction. The steel wires 32 include several first steel wires 321 and several second steel wires 322. The first steel wires 321 are disposed along the clockwise direction and the second steel wires 322 are disposed along the anti-clockwise direction. The first steel wires 321 and second steel wires 322 are interwoven with each other. Both ends of the first steel wire 321 are respectively connected with the upper the upper fixing loop 101 and the lower fixing loop 102. Each section of the upper fixing loop 101 within the upper fixing port 11 is connected with a first steel wire 321 and a second steel wire 322. Each section of the lower fixing loop 102 within the lower fixing port is connected with a first steel wire 321 and a second steel wire 322. A positioning cover 16 is covered on each section of the upper fixing loop 101 within the upper fixing port 11 and each section of the lower fixing loop 102 within the lower fixing port. Each of the ends of the positioning cover 16 is provided with a gap 161 to pass the first steel wire 321 and the second steel wire 322. A first hook part 12 and a second hook part 14 are respectively located within the gaps 161.

As shown in FIG. 4, each of the ends of the first steel wire 321 is provided with a first hook part 12. A first mounting hole 13 is formed between the first hook part 12 and the first steel wire 321 to pass the upper fixing loop 101 or the lower fixing loop 102. Each of the ends of the second steel wire 322 is provided with a second hook part 14. A second mounting hole 15 is formed between the second hook part 14 and the second steel wire 322 to pass the upper fixing loop 101 or the lower fixing loop 102. The first hook part 12 is not pressed against the first steel wire 321 during mounting. After the first steel wire is located at the upper fixing loop 101 or the lower fixing loop 102, the first hook part 12 is pressed against the first steel wire 321. The second hook part 14 is not pressed against the second steel wire 322 during mounting. After the second steel wire 322 is located at the upper fixing loop 101 or the lower fixing loop 102, the second hook part 14 is pressed against the second steel wire 322.

The edge of the base 2 has a first curl hem 91 between the lower fixing ports. A first fixed channel is formed between the first curl hem 91 and the base 2. The lower fixing loop 102 passes through the first fixed channel and is fixed on the base 2. The edge of the top ring 1 has a second curl hem 92 between the upper fixing ports 11. A second fixed channel is formed between the second curl hem 92 and the top ring 1. The upper fixing loop 101 passes through the second fixed channel and is fixed on the base 2.

Figure 7:
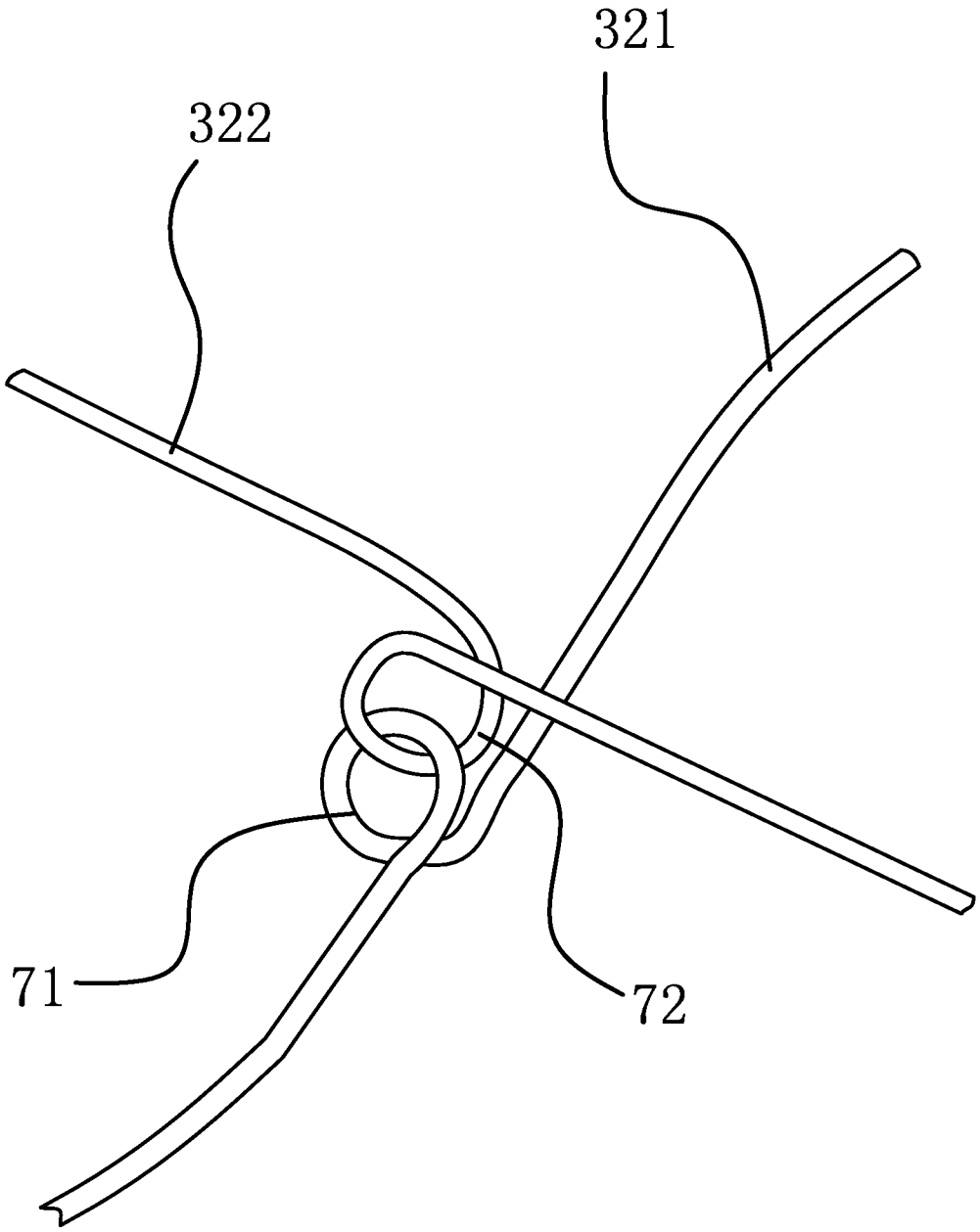
FIG. 7 is a diagram of the connection of one embodiment of the first steel wire with the second steel wire in the lantern of the invention.

As shown in FIG. 7, a first loop fastener 71 is formed by knotting in the middle of each first steel wire 321. A second loop fastener 72 is formed by knotting in the middle of each second steel wire 322. The first loop fastener 71 of the first steel wire 321 is fastened with the second loop fastener 72 of the second steel wire 322 at the intersection. The first steel wire 321 is fastened with the second steel wire 322 through the first loop fastener 72 and the second loop fastener 72, which increases the connection strength of the first steel wire 321 and second steel wire 322 and the strength of the lantern. The first steel wires 321 and the second steel wires 322 are both coated with anti-corrosive lacquer. The first steel wires 321 and the second steel wires 322 are interwoven with each other to form an interlaced configuration. The first steel wires 321 and the second steel wires 322 are configured so that two layers of housing of steel wires 32 are formed in the lantern. These two layers of housing of steel wires 32 interact with each other to largely increase the overall strength of the lantern. The overall strength of the steel wires 32 is increased thereby. The positions of both ends of the first steel wires 321 and second steel wires 322 are reasonably distributed, so that the housing of the lantern formed by the steel wires 32 will be under uniform stress, which further increase the overall strength of the lantern. The first loop fasteners 71 and second loop fasteners 72 could be wound by different loops according to actual circumstances. In the figure both the first loop fastener 71 and second loop fastener 72 are wound by only one loop.

The steel wires 32 in the figures are disposed obliquely and include second steel wires 322 inclined in an anti-clockwise direction and first steel wires 321 inclined in a clock-wise direction. The steel wires 32 inclined in opposite directions interweave each other. The steel wires project outward in an arc shape, so that the whole housing of the lantern could be in the shape of a sphere. In other embodiments, the steel wires 32 could be partly vertically disposed and partly obliquely disposed.

Second Embodiment

Figure 6:
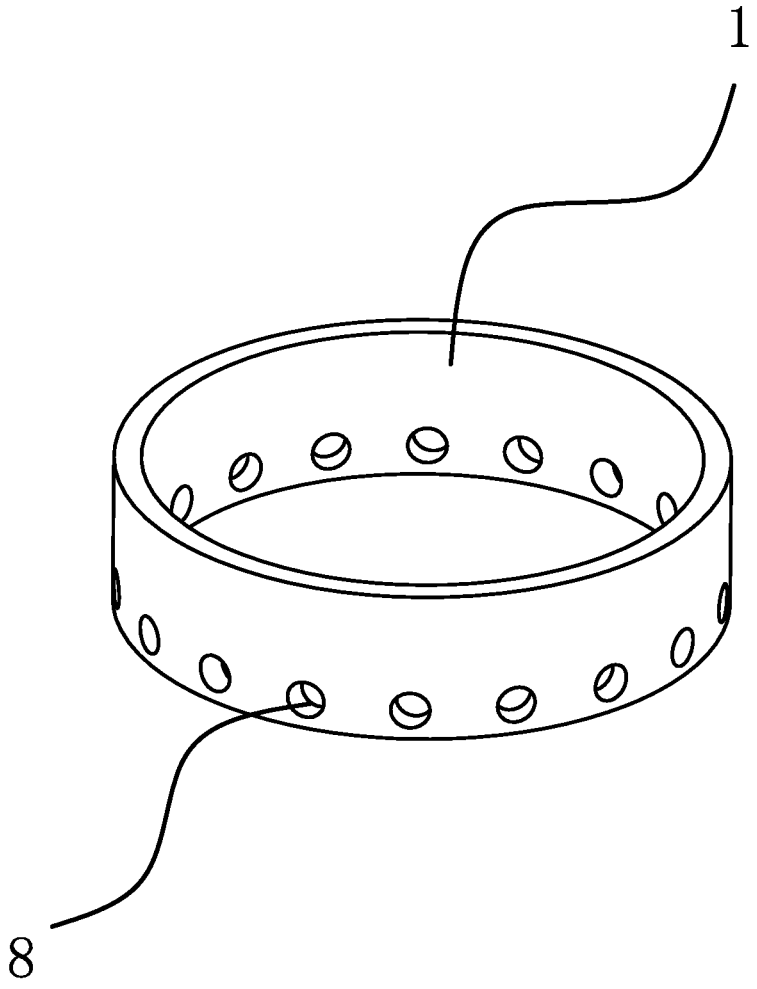
FIG. 6 is a structural diagram of one embodiment of the top ring in the lantern according to the second embodiment.

As shown in FIG. 6, this embodiment is substantially identical to the first embodiment except that connecting holes 8 could be directly opened on the annular edge of the top ring 1 and the base 2 to pass the steel wires 32, so that the first steel wires 321 pass through the connecting holes 8 and are wound around the rim thereof.

The embodiments described herein are merely illustrative of the spirit of the invention. It is obvious for those skilled in the art to make various modifications, supplements or alternatives to these embodiments without departing from the spirit of the invention or the scope of the invention as defined by the appended claims.

LIST OF REFERENCE NUMERALS

1 Top Ring
2 Base
3 Outer Lantern Body
31 Cylindrical Body
32 Steel Wire
321 First Steel Wire
322 Second Steel Wire
4 Hanger
41 Side Bar
42 Cross Bar
43 Couple
5 Grab
51 Fixing Plate
52 Side Plate
53 Clamp Plate
6 Transparent Housing
71 First Loop Fastener
72 Second Loop Fastener
8 Connecting Hole
9 Curl Hem
91 First Curl Hem
10 Fixing Loop
101 Upper Fixing Loop
11 Upper Fixing Port
12 First Hook Part
13 First Mounting Hole
14 Second Hook Part
15 Second Mounting hole
16 Positioning Cover
161 Gap

What is claimed is:

1. A lantern, comprising:

an outer lantern body (3), a top ring (1), a base (2) and a hanger (4), in which the outer lantern body (3) includes a cylindrical body (31) configured by interweaving a plurality of elastic steel wires (32), the top ring (1) and the base (2) are respectively connected with an upper and lower ends of the cylindrical body (31), characterized in that, the hanger (4) includes two parallel elastic side bars (41), an inner ends of the said two side bars (41) sequentially pass through the top ring (1) and the cylindrical body (31) and are fixed onto the base (2), several grabs (5) are fixed on the two side bars (41) along their lengthwise directions respectively, the grab (5) includes a fixing plate (51), a side plate (52) and a clamp plate (53), the fixing plate (51) is fixed on the side bar (41), an inner end of the side plate (52) is connected with the fixing plate (51) with an obtuse angle formed therebetween, an outer end of the side plate (52) is connected with the clamp plate (53), the clamp plate (53) is spaced from the side bar (41) with an opening formed therebetween to face the base (2), and the top ring (1) is capable of engaging with the opening.

2. The lantern as claimed in claim 1, characterized in that, the outer ends of the two side bars (41) are fixedly connected with each other via a cross bar (42), and a central part of the cross bar (42) bends outward to form a couple (43).

3. The lantern as claimed in claim 1, characterized in that, a transparent housing (6) is provided on the base (2), and an electronic candle is inserted within the transparent housing (6).

4. The lantern as claimed in claim 3, characterized in that, the thickness of the top ring (1) is smaller than the opening degree of the opening.

5. The lantern as claimed in claim 1, characterized in that, the obtuse angle formed between the side plate (52) and the fixing plate (51) is 135 degree.

6. The lantern as claimed in claim 1, characterized in that, connecting holes (8) are provided at an edge of the top ring (1) and base (2) to pass the steel wires (32).

7. The lantern as claimed in claim 1, characterized in that, both the top ring (1) and the base (2) are of an annular shape and provided with several circumferentially distributed curl hems (9), an annular fixing loop (10) is provided within the curl hem (9), and the steel wire (32) is fastened to the fixing loop (10).

8. The lantern as claimed in claim 7, characterized in that, the fixing loop (10) includes an upper fixing loop (101) fixed on the top ring (1) along the edge thereof and a lower fixing loop fixed on the base (2) along the edge thereof, the edge of the top ring (1) is provided with upper fixing ports (11) evenly distributed in the circumferential direction, the edge of the base (2) is provided with lower fixing ports evenly distributed in the circumferential direction, the steel wires (32) include several first steel wires (321) and several second steel wires (322) that are intersected with each other, both ends of the first steel wire (321) are connected with the upper fixing loop (101) and the lower fixing loop respectively, both ends of the second steel wire (322) are connected with the upper fixing loop (101) and the lower fixing loop respectively, each section of the upper fixing loop (101) within the upper fixing port (11) is connected with a first steel wire (321) and a second steel wire (322), and each section of the lower fixing loop within the lower fixing port is connected with a first steel wire (321) and a second steel wire (322).

9. The lantern as claimed in claim 8, characterized in that, the curl hem (9) includes a first curl hem (91) between the lower fixing ports on the edge of the base (2) and a second curl hem between the upper fixing ports (11) on the edge of the top ring (1), a first fixed channel is formed between the first curl hem (91) and the base (2), the lower fixing loop passes through the first fixed channel and is fixed on the base (2), a second fixed channel is formed between the second curl hem and the top ring (1), and the upper fixing loop (101) passes through the second fixed channel and is fixed on the base (2).

10. The lantern as claimed in claim 9, characterized in that, each of the ends of the first steel wire (321) is provided with a first hook part (12), a first mounting hole (13) is formed between the first hook part (12) and the first steel wire (321) to pass the upper fixing loop (101) or the lower fixing loop, each of the ends of the second steel wire (322) is provided with a second hook part (14), a second mounting hole (15) is formed between the second hook part (14) and the second steel wire (322) to pass the upper fixing loop (101) or the lower fixing loop.

11. The lantern as claimed in claim 8, characterized in that, the each section of the upper fixing loop (101) within the upper fixing port (11) and the each section of the lower fixing loop within the lower fixing port are both provided with a positioning cover (16), each of ends of the positioning cover (16) is provided with a gap (161) to pass the first steel wire (321) and the second steel wire (322), and the first hook part (12) and the second hook part (14) are respectively located within the gaps (161).

12. The lantern as claimed in claim 8, characterized in that, the first steel wires (321) are disposed along the clockwise direction and the second steel wires (322) are disposed along the anti-clockwise direction.

13. The lantern as claimed in claim 8, characterized in that, the first steel wires (321) are vertically disposed and the second steel wires (322) are obliquely disposed.

14. The lantern as claimed in claim 8, characterized in that, a first loop fastener (71) is formed by knotting in the middle of each of the said first steel wires (321), a second loop fastener (72) is formed by knotting in the middle of each of the said second steel wires (322), the first loop fastener (71) of the first steel wire (321) is fastened with the second loop fastener (72) of the second steel wire 322 at the intersection.

15. The lantern as claimed in claim 8, characterized in that, the steel wires (32) are coated with anti-corrosive lacquer.

* * * * *